US009217121B2

(12) United States Patent
Rüdenauer et al.

(10) Patent No.: US 9,217,121 B2
(45) Date of Patent: Dec. 22, 2015

(54) USE OF 4,8 DIMETHYL-3,7 NONADIEN-2-OL AS FRAGRANCE

(71) Applicant: BASF SE, Ludwigshafen (DE)

(72) Inventors: Stefan Rüdenauer, Worms (DE); Ralf Pelzer, Fürstenberg (DE); Wolfgang Krause, Brühl-Rohrhof (DE)

( * ) Notice: Subject to any disclaimer, the term of this patent is extended or adjusted under 35 U.S.C. 154(b) by 0 days.

(21) Appl. No.: 14/163,493

(22) Filed: Jan. 24, 2014

(65) Prior Publication Data

US 2014/0213494 A1 Jul. 31, 2014

Related U.S. Application Data

(60) Provisional application No. 61/756,492, filed on Jan. 25, 2013.

(51) Int. Cl.
*C11D 3/50* (2006.01)
*C11B 9/00* (2006.01)

(52) U.S. Cl.
CPC ..... *C11B 9/0015* (2013.01)

(58) Field of Classification Search
CPC ..... C11B 9/0015
USPC ..... 512/25
See application file for complete search history.

(56) References Cited

U.S. PATENT DOCUMENTS

| | | | | |
|---|---|---|---|---|
| 5,077,417 | A * | 12/1991 | Schulte-Elte et al. | 549/458 |
| 5,707,961 | A * | 1/1998 | Bajgrowicz et al. | 512/17 |
| 8,410,293 | B2 | 4/2013 | Ebel et al. | |
| 8,617,376 | B2 | 12/2013 | Malkowsky et al. | |
| 8,648,031 | B2 | 2/2014 | Ebel et al. | |
| 2001/0005711 | A1 | 6/2001 | Lambrecht et al. | |
| 2012/0277101 | A1 | 11/2012 | Klingelhoefer et al. | |
| 2013/0072726 | A1 | 3/2013 | Schuch et al. | |
| 2013/0137893 | A1 | 5/2013 | Ebel et al. | |
| 2013/0251647 | A1 | 9/2013 | Subkowski et al. | |
| 2013/0338402 | A1 | 12/2013 | Dehn et al. | |
| 2014/0024854 | A1 | 1/2014 | Schaub et al. | |
| 2014/0073817 | A1 | 3/2014 | Schaub et al. | |
| 2014/0073819 | A1 | 3/2014 | Rudenauer | |
| 2014/0100376 | A1 | 4/2014 | Malkowsky et al. | |
| 2014/0107352 | A1 | 4/2014 | Stork et al. | |
| 2014/0148619 | A1 | 5/2014 | Rudenauer et al. | |
| 2014/0163117 | A1 | 6/2014 | Rudenauer et al. | |

FOREIGN PATENT DOCUMENTS

| | | | |
|---|---|---|---|
| EP | 0743297 | A1 | 11/1996 |
| EP | 1417896 | A1 | 5/2004 |
| JP | 2004-091742 | A | 3/2004 |

OTHER PUBLICATIONS

U.S. Appl. No. 14/129,715, filed Jan. 28, 2014, Pelzer et al.
Agarwal, V.K., et al., Indian Perfumer, 27(2), 1983, pp. 112-118.
Austerweil, et al, in Comptres Rendus, 1910, pp. 440-441 (French, no English translation or abstract available).
Wawrzenczyk, C., et al., Perfumer & Flavorist, 1983, 8, pp. 39-41.
International Search Report for PCT/EP2014/051368 mailed on May 19, 2014.

* cited by examiner

*Primary Examiner* — John Hardee

(57) ABSTRACT

4,8-Dimethyl-3,7-nonadien-2-ol in which the weight ratio of (E)-4,8-dimethyl-3,7-nonadien-2-ol to the sum of (E)- and (Z)-4,8-dimethyl-3,7-nonadien-2-ol is at least 80% or in which the weight ratio of (Z)-4,8-dimethyl-3,7-nonadien-2-ol to the sum of (E)- and (Z)-4,8-dimethyl-3,7-nonadien-2-ol is at least 80%, is used as fragrance. The fragrances have a unique rose-like, floral character. Citrus-like, minty, green accompanying notes reminiscent of rhubarb arise.

17 Claims, No Drawings

USE OF 4,8 DIMETHYL-3,7 NONADIEN-2-OL AS FRAGRANCE

CROSS-REFERENCE TO RELATED APPLICATIONS

This application claims benefit (under 35 USC 119(e)) of U.S. Provisional Application 61/756,492, filed Jan. 25, 2013, which is incorporated by reference.

The present invention relates to the use of (E)- or (Z)-enriched 4,8-dimethyl-3,7-nonadien-2-ol as fragrance, and to fragrance compositions and perfumed articles which comprise this, to methods for conveying, modifying and/or intensifying a rose-like odor note, and to processes for the preparation of (E)- or (Z)-enriched 4,8-dimethyl-3,7-nonadien-2-ol.

Despite a large number of existing fragrances, there is a constant need in the perfume industry for new fragrances which, over and above their primary, namely odiferous (olfactory), properties, have additional positive secondary properties, such as e.g. an efficient mode of preparation, a higher stability under certain application conditions, a higher range or a better staying power, or else lead to better sensory profiles as a result of synergy effects with other fragrances.

In the perfume industry, there is also fundamentally a need for other fragrances which are suitable for producing fragrance compositions and/or perfumed articles. In particular, there is a need for fragrances which, by virtue of the technical properties mentioned above, lead to an increased benefit in fragrance compositions. Thus, for example as a result of using fragrances with an efficient mode of preparation, a higher stability and a better sensory profile, it is possible to optimize and/or minimize the amounts used and the number of fragrances in corresponding formulations, which leads to a sustainable conservation of resources during the perfuming of consumer articles.

In particular, there is a need for fragrances and fragrance compositions with rose-like notes. Within the context of the present invention, this is to be understood as meaning an odor which is similar to the odor of naturally occurring rose oil or like that of its constituents.

Citral (3,7-dimethylocta-2,6-dienal) is used widely as a fragrance. Citral imparts a lemon scent to essential oils such as e.g. lemon grass oil, May-Chang oil and also the peels of citrus fruits. It can either be isolated from natural sources or be produced synthetically, in which case it is usually produced in the form of a mixture of (E)-isomer (geranial) and (Z)-isomer (neral).

Hydrogenation products of citral such as e.g. the unsaturated alcohols geraniol ((E)-3,7-dimethyl-2,6-octadien-1-ol) and nerol ((Z)-3,7-dimethyl-2,6-octadien-1-ol) are likewise used as scent and aroma substances. The isomers have a rose-like and citrus-like scent, the (E)-isomer geraniol being present as the main constituent in geranium and rose oil, whereas the (Z)-isomer nerol is present as a main constituent in bergamot oil.

US 2001/0005711 A1 describes fragrance mixtures which comprise 4,8-dimethyl-3,7-nonadien-2-one. Low concentrations of this molecule in fragrance compositions lead to fresh, rounded scent notes. The described fragrance compositions can comprise further aromatic principles, in which case some of many additional substances may be e.g. 4,8-dimethyl-3,7-nonadien-2-ol, geraniol, tetrahydrogeraniol, nerol, geranial and neral.

EP 1417896 A1 describes a method for enriching, intensifying, modifying or imparting a berry or citrus aroma or taste in a food or a water-containing beverage. For this purpose, at least one oxo-terpene-carbinol derivative is used, where one of the different derivatives used is 4,8-dimethyl-3,7-nonadien-2-ol. However, the use of a specific isomer of this compound is not described.

A modification of a functional group can also lead to considerably different olfactory properties in otherwise structurally similar compounds.

The olfactory properties of 4,8-dimethyl-3,7-nonadien-2-ol are described as "narcissus", whereas 4,8-dimethyl-3,7-nonadien-2-one smells "fruity". Generally, the scents of secondary alcohols are described as being unpleasant whereas the corresponding acetates and ketones have pleasant scents (Indian Perfumer, 1983, 27, 112-18).

The publication "Synthesis and odor characteristics of some homologs of acyclic terpenoids" by C. Wawrzenczyk in "Parfumer and Flavorist" (1983) describes the odor of a mixture of 60% (E)-4,8-dimethyl-3,7-nonadien-2-ol and 40% (Z)-4,8-dimethyl-3,7-nonadien-2-ol as intense, pungent and smelling of fungus.

On pages 440 and 441 of the publication "Sur certaines causes des odeurs gèraniques" by G. Austerweil in "Comptes rendus hebdomadaires de sciences" (1910), 1-methylgeraniol, which smells of "geranium", is obtained by the reaction of citral with a Grignard reagent. Citral is an isomer mixture of geranial and neral. During the reaction with Grignard reagents, the E/Z isomer distribution of the starting material is retained.

Accordingly, although mixtures of the isomers of 4,8-dimethyl-3,7-nonadien-2-ol are described in the prior art, there is no consistent information about the odor of these mixtures. A mixture of 60% (E) and 40% (Z) isomers has been classified as unpleasant smelling.

The present invention firstly provides the use of 4,8-dimethyl-3,7-nonadien-2-ol as fragrance, wherein the weight ratio of (E)-4,8-dimethyl-3,7-nonadien-2-ol to the sum of (E)- and (Z)-4,8-dimethyl-3,7-nonadien-2-ol is at least 80%.

The present invention further provides the use of 4,8-dimethyl-3,7-nonadien-2-ol as fragrance, wherein the weight ratio of (Z)-4,8-dimethyl-3,7-nonadien-2-ol to the sum of (E)- and (Z)-4,8-dimethyl-3,7-nonadien-2-ol is at least 80%.

Moreover, the present invention relates to a fragrance composition comprising 4,8-dimethyl-3,7-nonadien-2-ol, wherein the weight ratio of (E)-4,8-dimethyl-3,7-nonadien-2-ol to the sum of (E)- and (Z)-4,8-dimethyl-3,7-nonadien-2-ol is at least 80%.

Moreover, the present invention relates to a fragrance composition comprising 4,8-dimethyl-3,7-nonadien-2-ol, wherein the weight ratio of (Z)-4,8-dimethyl-3,7-nonadien-2-ol to the sum of (E)- and (Z)-4,8-dimethyl-3,7-nonadien-2-ol is at least 80%.

Moreover, the present invention relates to a perfumed article comprising 4,8-dimethyl-3,7-nonadien-2-ol, wherein the weight ratio of (E)-4,8-dimethyl-3,7-nonadien-2-ol to the sum of (E)- and (Z)-4,8-dimethyl-3,7-nonadien-2-ol is at least 80%.

Moreover, the present invention relates to a perfumed article comprising 4,8-dimethyl-3,7-nonadien-2-ol, wherein the weight ratio of (Z)-4,8-dimethyl-3,7-nonadien-2-ol to the sum of (E)- and (Z)-4,8-dimethyl-3,7-nonadien-2-ol is at least 80%.

The present invention also relates to methods for conveying, modifying and/or intensifying a rose-like odor note in a fragrance composition by admixing a sensorily effective amount of 4,8-dimethyl-3,7-nonadien-2-ol, wherein the weight ratio of (E)-4,8-dimethyl-3,7-nonadien-2-ol to the sum of (E)- and (Z)-4,8-dimethyl-3,7-nonadien-2-ol is at least 80%.

The present invention also relates to methods for conveying, modifying and/or intensifying a rose-like odor note in a fragrance composition by admixing a sensorily effective amount of 4,8-dimethyl-3,7-nonadien-2-ol, wherein the weight ratio of (Z)-4,8-dimethyl-3,7-nonadien-2-ol to the sum of (E)- and (Z)-4,8-dimethyl-3,7-nonadien-2-ol is at least 80%.

The present invention also relates to a process for the preparation of 4,8-dimethyl-3,7-nonadien-2-ol suitable as fragrance by reacting 3,7-dimethylocta-2,6-dienal, wherein the weight ratio of (E)-3,7-dimethylocta-2,6-dienal to the sum of (E)-3,7-dimethylocta-2,6-dienal and (Z)-3,7-dimethylocta-2,6-dienal is at least 80%, with an organometallic compound which transfers methyl groups.

The present invention also relates to a process for the preparation of 4,8-dimethyl-3,7-nonadien-2-ol suitable as fragrance by reacting 3,7-dimethylocta-2,6-dienal, wherein the weight ratio of (Z)-3,7-dimethylocta-2,6-dienal to the sum of (E)-3,7-dimethylocta-2,6-dienal and (Z)-3,7-dimethylocta-2,6-dienal is at least 80%, with an organometallic compound which transfers methyl groups.

Within the context of the present invention, "fragrance" is to be understood as meaning natural or synthetic substances with an intrinsic odor. The intrinsic odor may be pleasant smelling, aversive or foul-smelling.

Within the context of the present invention, "odor" or the "olfactory perception" is the interpretation of the sensory stimuli which are delivered by the chemoreceptors of the nose or other olfactory organs to the brain of a living being. The odor can consequently be a sensory perception by the nose of fragrances which takes place upon breathing in. The air here serves as an odor carrier.

Within the context of the present invention, "scent" is to be understood as meaning a pleasant smelling odor.

(E)-4,8-Dimethyl-3,7-nonadien-2-ol is a compound of the formula (I):

(I)

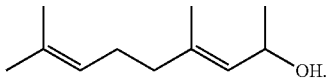

(Z)-4,8-Dimethyl-3,7-nonadien-2-ol is a compound of the formula (II):

(II)

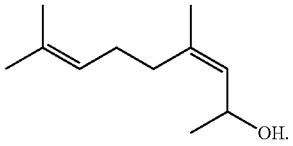

The 4,8-dimethyl-3,7-nonadien-2-ol to be used according to the invention can be present as a pure isomer or as an isomer mixture enriched with regard to one isomer. Unless otherwise evident from the context, the statements and preferred embodiments given below apply to the use according to the invention, the fragrance composition according to the invention, the perfumed article according to the invention and the method according to the invention for conveying, modifying and/or intensifying an odor note.

In one embodiment, the weight ratio of (E)-4,8-dimethyl-3,7-nonadien-2-ol to the sum of (E)- and (Z)-4,8-dimethyl-3,7-nonadien-2-ol is at least 80%, preferably at least 85%, further preferably at least 90%, particularly preferably at least 95%, further particularly preferably at least 97% and especially preferably 100%. The weight ratio of (E)-4,8-dimethyl-3,7-nonadien-2-ol to the sum of (E)- and (Z)-4,8-dimethyl-3,7-nonadien-2-ol can be e.g. 80 to 99%. Such a mixture (including pure (E)-4,8-dimethyl-3,7-nonadien-2-ol) is referred to hereinbelow as (E)-enriched 4,8-dimethyl-3,7-nonadien-2-ol.

(E)-Enriched 4,8-dimethyl-3,7-nonadien-2-ol is suitable for use as fragrance, in particular for producing a rose scent. The fact that (E)-enriched 4,8-dimethyl-3,7-nonadien-2-ol has an expressive rose-like odor without undesired notes is particularly surprising since a mixture of 60% (E)-4,8-dimethyl-3,7-nonadien-2-ol and 40% (Z)-4,8-dimethyl-3,7-nonadien-2-ol has been classified as smelling of fungus.

In a further embodiment, the weight ratio of (Z)-4,8-dimethyl-3,7-nonadien-2-ol to the sum of (E)- and (Z)-4,8-dimethyl-3,7-nonadien-2-ol is at least 80%, preferably at least 85%, further preferably at least 90%, particularly preferably at least 95%, further particularly preferably at least 97% and especially preferably 100%. The weight ratio of (Z)-4,8-dimethyl-3,7-nonadien-2-ol to the sum of (E)- and (Z)-4,8-dimethyl-3,7-nonadien-2-ol can be e.g. 80 to 99%. Such a mixture (including pure (Z)-4,8-dimethyl-3,7-nonadien-2-ol) is referred to hereinbelow as (Z)-enriched 4,8-d imethyl-3,7-nonadien-2-ol.

(Z)-Enriched 4,8-dimethyl-3,7-nonadien-2-ol is suitable for use as fragrance, in particular for producing a rose scent. The fact that (Z)-enriched 4,8-dimethyl-3,7-nonadien-2-ol has an expressive rose-like odor without undesired notes is surprising since a mixture of 60% (E)-4,8-dimethyl-3,7-nonadien-2-ol and 40% (Z)-4,8-dimethyl-3,7-nonadien-2-ol has been classified as smelling of fungus.

(E)- or (Z)-enriched 4,8-dimethyl-3,7-nonadien-2-ol are suitable for the use according to the invention not only on account of the described odor notes but also on account of their efficient mode of preparation, as well as material properties such as solubility in common cosmetic solvents and compatibility with the other customary constituents of such products. Moreover, the toxicological acceptability of these fragrances underlines their particular suitability.

According to a further aspect, the fragrances used according to the invention are used, especially for the purpose of more efficient handling and metering, also as fragrance mixtures with diluents or solvents. Here, the fraction of the fragrances, based on the sum of fragrances and solvents, is given in % by weight.

Within the context of the present invention, a "solvent" serves for the dilution of the fragrances to be used according to the invention or of the fragrance compositions according to the invention without having their own odiferous properties. Some solvents have fixing properties at the same time.

The (E)- or (Z)-enriched 4,8-dimethyl-3,7-nonadien-2-ol can be admixed with a diluent or solvent in an amount of 1 to 99% by weight. Preference is given to at least 40% strength by weight solutions, further preferably at least 50% strength by weight solutions, furthermore preferably at least 60% strength by weight solutions, further preferably at least 70% strength by weight solutions, especially preferably at least 80% strength by weight solutions, furthermore especially preferably at least 90% strength by weight solutions, preferably in perfumistically acceptable solvents.

Preferred perfumistically acceptable solvents are ethanol, dipropylene glycol (DPG), propylene glycol, 1,2-butylene glycol, glycerol, diethylene glycol monoethyl ether, diethyl phthalate (DEP), isopropyl myristate (IPM), triethyl citrate (TEC), benzyl benzoate (BB) and benzyl acetate. Here, in turn preference is given to ethanol, diethyl phthalate, propylene glycol, dipropylene glycol, triethyl citrate, benzyl benzoate and isopropyl myristate.

Within the context of the present invention, a "fragrance composition" is a mixture which comprises at least one further fragrance as well as (E)- or (Z)-enriched 4,8-dimethyl-3,7-nonadien-2-ol. In particular, such a fragrance composition may be a perfume composition (a perfume oil).

Fragrance compositions according to the invention comprise, based on the total amount of the fragrance composition, e.g. an amount of (E)-enriched 4,8-dimethyl-3,7-nonadien-2-ol of 0.01 to 65% by weight, preferably of about 0.1 to about 50% by weight, preferably of about 0.5 to about 30% by weight and particularly preferably of about 0.5 to about 25% by weight. The weight ratio of (E)-enriched 4,8-dimethyl-3,7-nonadien-2-ol to the total amount of further fragrances (different from 4,8-dimethyl-3,7-nonadien-2-ol) is e.g. in the range from 1:1000 to 1:0.5, preferably in the range from 1:700 to 1:1, particularly preferably in the range from 1:500 to 1:10.

Fragrance compositions according to the invention comprise, based on the total amount of the fragrance composition, e.g. an amount of (Z)-enriched 4,8-dimethyl-3,7-nonadien-2-ol of 0.01 to 65% by weight, preferably of about 0.1 to about 50% by weight, preferably of about 0.5 to about 30% by weight and particularly preferably of about 0.5 to about 25% by weight. The weight ratio of (Z)-enriched 4,8-dimethyl-3,7-nonadien-2-ol to the total amount of further fragrances (different from 4,8-dimethyl-3,7-nonadien-2-ol) is e.g. in the range from 1:1000 to 1:0.5, preferably in the range from 1:700 to 1:1, particularly preferably in the range from 1:500 to 1:10.

Within the context of the present invention, a "perfume" is a mixture of fragrances and alcohol.

Within the context of the present invention, a "perfume composition" is a perfume which comprises different amounts of individual components matched to one another to be in harmony. The properties of the individual constituents are utilized in order to provide a new overall image in the combination, where the characteristics of the ingredients retire into the background, but without being suppressed.

Within the context of the present invention, a "perfume oil" is a concentrated mixture of aromatic principles and fragrances which are used e.g. in alcoholic solutions for perfuming a variety of products.

Fragrance compositions according to the invention comprise, as well as (E)- or (Z)-enriched 4,8-dimethyl-3,7-nonadien-2-ol, at least one further fragrance, preferably 2, 3, 4, 5, 6, 7, 8 or more further fragrances, where further fragrances are selected e.g. from among:

Alpha-hexylcinnamaldehyde 2-phenoxyethyl isobutyrate (Phenirat[1]), dihydromyrcenol (2,6-dimethyl-7-octen-2-ol), methyl dihydrojasmonate (preferably with a content of cis isomer of more than 60% by weight) (Hedione[9], Hedione HC[9]), 4,6,6,7,8,8-hexamethyl-1,3,4,6,7,8-hexahydrocyclopenta[g]benzopyran (Galaxolid[3]), tetrahydrolinalool (3,7-dimethyloctan-3-ol), ethyllinalool, benzyl salicylate, 2-methyl-3-(4-tert-butylphenyl)propanal (Lilial[2]), cinnamyl alcohol, 4,7-methano-3a,4,5,6,7,7a-hexahydro-5-indenyl acetate and/or 4,7-methano-3a,4,5,6,7,7a-hexahydro-6-indenyl acetate (Herbafloratl), citronellol, citronellyl acetate, tetrahydrogeraniol, vanillin, linalyl acetate, styrolyl acetate (1-phenylethyl acetate), octahydro-2,3,8,8-tetramethyl-2-acetonaphthone and/or 2-acetyl-1,2,3,4,6,7,8-octahydro-2,3,8,8-tetramethyl-naphthalene (Iso E Super[3]), hexyl salicylate, 4-tert-butylcyclohexyl acetate (Oryclone[1]), 2-tert-butylcyclohexyl acetate (Agrumex HC[1]), alpha-ionone (4-(2,2,6-trimethyl-2-cyclohexen-1-yl)-3-buten-2-one), n-alpha-methylionone, alpha-isomethylionone, coumarin, terpinyl acetate, 2-phenylethyl alcohol, 4-(4-hydroxy-4-methylpentyl)-3-cyclohexenecarboxaldehyde (Lyral[3]), alpha-amylcinnamaldehyde, ethylene brassylate, (E)- and/or (Z)-3-methylcyclopentadec-5-enone (Muscenon[9]), 15-pentadec-11-enolide and/or 15-pentadec-12-enolide (Globalide[1]), 15-cyclopentadecanolide (Macrolide[1]), 1-(5,6,7,8-tetrahydro-3,5,5,6,8,8-hexamethyl-2-naphthalenyl)ethanone (Tonalid[10]), 2-isobutyl-4-methyltetrahydro-2H-pyran-4-ol (Florol[9]), 2-ethyl-4-(2,2,3-trimethyl-3-cyclopenten-1-yl)-2-buten-1-ol (Sandolen[1]), cis-3-hexenyl acetate, trans-3-hexenyl acetate, trans-2,cis-6-nonadienol, 2,4-dimethyl-3-cyclohexenecarboxaldehyde (Vertocitral[1]), 2,4,4,7-tetramethyloct-6-en-3-one (Claritone[1]), 2,6-dimethyl-5-hepten-1-al (Melonal[2]), borneol, 3-(3-isopropylphenyl)butanal (Florhydral[2]), 2-methyl-3-(3,4-methylenedioxyphenyl)propanal (Helional[3]), 3-(4-ethylphenyl)-2,2-dimethylpropanal (Florazon[1]), 7-methyl-2H-1,5-benzodioxepin-3(4H)-one (Calone[19515]), 3,3,5-trimethylcyclohexyl acetate (preferably with a content of cis isomers of 70% by weight) or more and 2,5,5-trimethyl-1,2,3,4,4a,5,6,7-octahydronaphthalen-2-ol (Ambrinol S[1]). Within the context of the present invention, the aforementioned fragrances are accordingly preferably combined with mixtures according to the invention.

Where trade names are given above, these refer to the following sources:

[1] trade name of Symrise GmbH, Germany;

[2] trade name of Givaudan AG, Switzerland;

[3] trade name of International Flavors & Fragrances Inc., USA;

[5] trade name of Danisco Seillans S.A., France;

[9] trade name of Firmenich S.A., Switzerland;

[10] trade name of PFW Aroma Chemicals B.V., the Netherlands.

Further fragrances with which (E)- or (Z)-enriched 4,8-dimethyl-3,7-nonadien-2-ol can advantageously be combined to give a fragrance composition can be found e.g. in S. Arctander, Perfume and Flavor Chemicals, Vol. I and II, Montclair, N.J., 1969, self-published or K. Bauer, D. Garbe and H. Surburg, Common Fragrance and Flavor Materials, 4th Ed., Wiley-VCH, Weinheim 2001. Specifically, mention may be made of:

extracts from natural raw materials such as essential oils, concretes, absolutes, resins, resinoids, balsams, tinctures such as e.g.

ambergris tincture; amyris oil; angelica seed oil; angelica root oil; aniseed oil; valerian oil; basil oil; tree moss absolute; bay oil; lungwort oil; benzoin resin; bergamot oil; beeswax absolute; birch tar oil; bitter almond oil; savory oil; buchu leaf oil; cabreuva oil; cade oil; calmus oil; camphor oil; cananga oil; cardamom oil; cascarilla oil; cassia oil; cassia absolute; castoreum absolute; cedar leaf oil; cedar wood oil; cistus oil; citronella oil; lemon oil; copaiba balsam; copaiba balsam oil; coriander oil; costus root oil; cumin oil; cypress oil; davana oil; dill weed oil; dill seed oil; Eau de brouts absolute; oak moss absolute; elemi oil; tarragon oil; eucalyptus citriodora oil; eucalyptus oil; fennel oil; pine needle oil; galbanum oil; galbanum resin; geranium oil; grapefruit oil; guaiacwood oil; gurjun balsam; gurjun balsam oil; helichrysum absolute; helichrysum oil; ginger oil; iris root absolute; iris root oil; jasmine absolute; calmus oil; camomile oil blue; roman camomile oil; carrot seed oil; cascarilla oil; pine needle oil; spearmint oil; caraway oil; labdanum oil; labdanum absolute; labdanum resin; lavandin absolute; lavandin oil; lavender absolute; lavender oil; lemon grass oil; lovage oil; lime oil distilled; lime oil pressed; linalool oil; litsea cubeba oil; laurel leaf oil; mace oil; marjoram oil; mandarin oil; massoia bark oil; mimosa absolute; musk seed oil; musk tincture; clary sage oil; nutmeg oil; myrrh absolute; myrrh oil; myrtle oil; clove leaf oil; clove flower oil; neroli oil; olibanum absolute; olibanum oil; opopanax oil; orange blossom absolute; orange oil; origanum oil; palmarosa oil; patchouli oil; perilla oil; peru balsam oil; parsley leaf oil; parsley seed oil; petitgrain oil; peppermint oil; pepper oil; pimento oil; pine oil; pennyroyal oil; rose absolute; rose wood oil; rose oil; rosemary oil; Dalmatian sage oil; Spanish sage oil; sandalwood oil; celery seed oil; spike-lavender oil; star anise oil; styrax oil; tagetes oil; fir needle oil; tea tree oil; turpentine oil; thyme oil; tolubalsam; tonka absolute; tuberose absolute; vanilla extract; violet leaf absolute; verbena oil; vetiver oil; juniper berry oil; wine lees oil; wormwood oil; winter green oil; ylang ylang oil; hyssop oil; civet absolute; cinnamon leaf oil; cinnamon bark oil, and fractions thereof, or ingredients isolated therefrom;

individual fragrances from the group of hydrocarbons, such as e.g. 3-carene; alpha-pinene; beta-pinene; alpha-terpinene; gamma-terpinene; p-cymene; bisabolene; camphene; caryophyllene; cedrene; farnesene; limonene; longifolene; myrcene; ocimene; valencene; (E,Z)-1,3,5-undecatriene; styrene; diphenylmethane;

the aliphatic alcohols such as e.g. hexanol; octanol; 3-octanol; 2,6-dimethylheptanol; 2-methyl-2-heptanol; 2-methyl-2-octanol; (E)-2-hexenol; (E)- and (Z)-3-hexenol; 1-octen-3-ol; mixture of 3,4,5,6,6-pentamethyl-3/4-hepten-2-ol and 3,5,6,6-tetramethyl-4-methyleneheptan-2-ol; (E,Z)-2,6-nonadienol; 3,7-dimethyl-7-methoxyoctan-2-ol; 9-decenol; 10-undecenol; 4-methyl-3-decen-5-ol;

the aliphatic aldehydes and acetals thereof such as e.g. hexanal; heptanal; octanal; nonanal; decanal; undecanal; dodecanal; tridecanal; 2-methyloctanal; 2-methylnonanal; (E)-2-hexenal; (Z)-4-heptenal; 2,6-dimethyl-5-heptenal; 10-undecenal; (E)-4-decenal; 2-dodecenal; 2,6,10-trimethyl-9-undecenal; 2,6,10-trimethyl-5,9-undecadienal; heptanal diethylacetal; 1,1-dimethoxy-2,2,5-trimethyl-4-hexene; citronellyloxyacetaldehyde; 1-(1-methoxypropoxy)-(E/Z)-3-hexene; the aliphatic ketones and oximes thereof such as e.g. 2-heptanone; 2-octanone; 3-octanone; 2-nonanone; 5-methyl-3-heptanone; 5-methyl-3-heptanone oxime; 2,4,4,7-tetramethyl-6-octen-3-one; 6-methyl-5-hepten-2-one;

the aliphatic sulfur-containing compounds such as e.g. 3-methylthiohexanol; 3-methylthiohexyl acetate; 3-mercaptohexanol; 3-mercaptohexyl acetate; 3-mercaptohexyl butyrate; 3-acetylthiohexyl acetate; 1-menthene-8-thiol;

the aliphatic nitriles such as e.g. 2-nonenenitrile; 2-undecenenitrile; 2-tridecenenitrile; 3,12-tridecadienenitrile; 3,7-dimethyl-2,6-octadienenitrile; 3,7-dimethyl-6-octenenitrile;

the esters of aliphatic carboxylic acids such as e.g. (E)- and (Z)-3-hexenyl formate; ethyl acetoacetate; isoamyl acetate; hexyl acetate; 3,5,5-trimethylhexyl acetate; 3-methyl-2-butenyl acetate; (E)-2-hexenyl acetate; (E)- and (Z)-3-hexenyl acetate; octyl acetate; 3-octyl acetate; 1-octen-3-yl acetate; ethyl butyrate; butyl butyrate; isoamyl butyrate; hexyl butyrate; (E)- and (Z)-3-hexenyl isobutyrate; hexyl crotonate; ethyl isovalerate; ethyl 2-methylpentanoate; ethyl hexanoate; allyl hexanoate; ethyl heptanoate; allyl heptanoate; ethyl octanoate; ethyl (E,Z)-2,4-decadienoate; methyl 2-octinate; methyl 2-noninate; allyl 2-isoamyloxy acetate; methyl-3,7-dimethyl-2,6-octadienoate; 4-methyl-2-pentyl crotonate;

the acyclic terpene alcohols such as e.g. geraniol; nerol; linalool; lavandulol; nerolidol; farnesol; tetrahydrolinalool; 2,6-dimethyl-7-octen-2-ol; 2,6-dimethyloctan-2-ol; 2-methyl-6-methylene-7-octen-2-ol; 2,6-dimethyl-5,7-octadien-2-ol; 2,6-dimethyl-3,5-octadien-2-ol; 3,7-dimethyl-4,6-octadien-3-ol; 3,7-dimethyl-1,5,7-octatrien-3-ol; 2,6-dimethyl-2,5,7-octatrien-1-ol; and the formates, acetates, propionates, isobutyrates, butyrates, isovalerates, pentanoates, hexanoates, crotonates, tiglinates and 3-methyl-2-butenoates thereof;

the acyclic terpene aldehydes and ketones such as e.g. geranial; neral; citronellal; 7-hydroxy-3,7-dimethyloctanal; 7-methoxy-3,7-dimethyloctanal; 2,6,10-trimethyl-9-undecenal; geranyl acetone; as well as the dimethyl- and diethylacetals of geranial, neral, 7-hydroxy-3,7-dimethyloctanal; the cyclic terpene alcohols such as e.g. menthol; isopulegol; alpha-terpineol; terpineol-4; menthan-8-ol; menthan-1-ol; menthan-7-ol; borneol; isoborneol; linalool oxide; nopol; cedrol; ambrinol; vetiverol; guajol; and the formates, acetates, propionates, isobutyrates, butyrates, isovalerates, pentanoates, hexanoates, crotonates, tiglinates and 3-methyl-2-butenoates thereof;

the cyclic terpene aldehydes and ketones such as e.g. menthone; isomenthone; 8-mercaptomenthan-3-one; carvone; camphor; fenchone; alpha-ionone; beta-ionone; alpha-n-methylionone; beta-n-methylionone; alpha-isomethylionone; beta-isomethylionone; alpha-irone; alpha-damascone; beta-damascone; beta-damascenone; delta-damascone; gamma-damascone; 1-(2,4,4-trimethyl-2-cyclohexen-1-yl)-2-buten-1-one; 1,3,4,6,7,8a-hexahydro-1,1,5,5-tetramethyl-2H-2,4a-methano-naphthalene-8(5H)-one; 2-methyl-4-(2,6,6-trimethyl-1-cyclohexen-1-yl)-2-butenal; nootkatone; dihydronootkatone; 4,6,8-megastigmatrien-3-one; alpha-sinensal; beta-sinensal; acetylated cedar wood oil (methyl cedryl ketone);

the cyclic alcohols such as e.g. 4-tert-butylcyclohexanol; 3,3,5-trimethylcyclohexanol; 3-isocamphylcyclohexanol; 2,6,9-trimethyl-Z2,Z5,E9-cyclododecatrien-1-ol; 2-isobutyl-4-methyltetrahydro-2H-pyran-4-ol;

the cycloaliphatic alcohols such as e.g. alpha,3,3-trimethylcyclohexylmethanol; 1-(4-isopropylcyclohexyl)ethanol; 2-methyl-4-(2,2,3-trimethyl-3-cyclopent-1-yl)butanol; 2-methyl-4-(2,2,3-trimethyl-3-cyclopent-1-yl)-2-buten-1-ol; 2-ethyl-4-(2,2,3-trimethyl-3-cyclopent-1-yl)-2-buten-1-ol; 3-methyl-5-(2,2,3-trimethyl-3-cyclopent-1-yl)pentan-2-ol; 3-methyl-5-(2,2,3-trimethyl-3-cyclopent-1-yl)-4-penten-2-ol; 3,3-dimethyl-5-(2,2,3-trimethyl-3-cyclopent-1-yl)-4-penten-2-ol; 1-(2,2,6-trimethylcyclohexyl)pentan-3-ol; 1-(2,2,6-trimethylcyclohexyl)hexan-3-ol;

the cyclic and cycloaliphatic ethers such as e.g. cineol; cedryl methyl ether; cyclododecyl methyl ether; 1,1-dimethoxycyclododecane; (ethoxymethoxy)cyclododecane; alpha-cedrene epoxide; 3a,6,6,9a-tetramethyldodecahydronaphtho[2,1-b]furan; 3a-ethyl-6,6,9a-trimethyldodecahydronaphtho[2,1-b]furan; 1,5,9-trimethyl-13-oxabicyclo-[10.1.0]trideca-4,8-diene; rose oxide; 2-(2,4-dimethyl-3-cyclohexen-1-yl)-5-methyl-5-(1-methylpropyl)-1,3-dioxane;

the cyclic and macrocyclic ketones such as e.g. 4-tert-butylcyclohexanone; 2,2,5-trimethyl-5-pentylcyclopentanone; 2-heptylcyclopentanone; 2-pentylcyclopentanone; 2-hydroxy-3-methyl-2-cyclopenten-1-one; 3-methyl-cis-2-penten-1-yl-2-cyclopenten-1-one; 3-methyl-2-pentyl-2-cyclopenten-1-one; 3-methyl-4-cyclopentadecenone; 3-methyl-5-cyclopentadecenone; 3-methylcyclopentadecanone; 4-(1-ethoxyvinyl)-3,3,5,5-tetramethylcyclohexanone; 4-tert-pentylcyclohexanone; 5-cyclohexadecen-1-one; 6,7-dihydro-1,1,2,3,3-pentamethyl-4(5H)-indanone; 8-cyclohexadecen-1-one; 7-cyclohexadecen-1-one; (7/8)-cyclohexadecen-1-one; 9-cycloheptadecen-1-one; cyclopentadecanone; cyclohexadecanone;

the cycloaliphatic aldehydes such as e.g. 2,4-dimethyl-3-cyclohexenecarbaldehyde; 2-methyl-4-(2,2,6-trimethylcyclohexen-1-yl)-2-butenal; 4-(4-hydroxy-4-methylpentyl)-3-cyclohexenecarbaldehyde; 4-(4-methyl-3-penten-1-yl)-3-cyclohexenecarbaldehyde;

the cycloaliphatic ketones such as e.g. 1-(3,3-dimethylcyclohexyl)-4-penten-1-one; 2,2-dimethyl-1-(2,4-dimethyl-3-cyclohexen-1-yl)-1-propanone; 1-(5,5-dimethyl-1-cyclohexen-1-yl)-4-penten-1-one; 2,3,8,8-tetramethyl-1,2,3,4,5,6,7,8-octahydro-2-naphthalenyl methyl ketone; methyl 2,6,10-trimethyl-2,5,9-cyclododecatrienyl ketone; tert-butyl (2,4-dimethyl-3-cyclohexen-1-yl) ketone;

the esters of cyclic alcohols such as e.g. 2-tert-butylcyclohexyl acetate; 4-tert-butylcyclohexyl acetate; 2-tert-pentylcyclohexyl acetate; 4-tert-pentylcyclohexyl acetate; 3,3,5-trimethylcyclohexyl acetate; decahydro-2-naphthyl acetate; 2-cyclopentylcyclopentyl crotonate; 3-pentyltetrahydro-2H-pyran-4-yl acetate; decahydro-2,5,5,8a-tetramethyl-2-naphthyl acetate; 4,7-methano-3a,4,5,6,7,7a-hexahydro-5 or 6-indenyl acetate; 4,7-methano-3a,4,5,6,7,7a-hexahydro-5 or 6-indenyl propionate; 4,7-methano-3a,4,5,6,7,7a-hexahydro-5 or 6-indenyl isobutyrate; 4,7-methanooctahydro-5 or 6-indenyl acetate;

the esters of cycloaliphatic alcohols such as e.g. 1-cyclohexylethyl crotonate;

the esters of cycloaliphatic carboxylic acids such as e.g. allyl 3-cyclohexylpropionate; allyl cyclohexyloxyacetate; cis- and trans-methyl dihydrojasmonate; cis- and trans-methyl jasmonate; methyl 2-hexyl-3-oxocyclopentanecarboxylate; ethyl 2-ethyl-6,6-dimethyl-2-cyclohexenecarboxylate; ethyl 2,3,6,6-tetramethyl-2-cyclohexenecarboxylate; ethyl 2-methyl-1,3-dioxolane-2-acetate;

the araliphatic alcohols such as e.g. benzyl alcohol; 1-phenylethyl alcohol, 2-phenylethyl alcohol, 3-phenylpropanol; 2-phenylpropanol; 2-phenoxyethanol; 2,2-dimethyl-3-phenylpropanol; 2,2-dimethyl-3-(3-methylphenyl)propanol; 1,1-dimethyl-2-phenylethyl alcohol; 1,1-dimethyl-3-phenylpropanol; 1-ethyl-1-methyl-3-phenylpropanol; 2-methyl-5-phenylpentanol; 3-methyl-5-phenylpentanol; 3-phenyl-2-propen-1-ol; 4-methoxybenzyl alcohol; 1-(4-isopropylphenyl)ethanol;

the esters of araliphatic alcohols and aliphatic carboxylic acids such as e.g. benzyl acetate; benzyl propionate; benzyl isobutyrate; benzyl isovalerate; 2-phenylethyl acetate; 2-phenylethyl propionate; 2-phenylethyl isobutyrate; 2-phenylethyl isovalerate; 1-phenylethyl acetate; alpha-trichloromethylbenzyl acetate; alpha,alpha-dimethylphenylethyl acetate; alpha,alpha-dimethylphenylethyl butyrate; cinnamyl acetate; 2-phenoxyethyl isobutyrate; 4-methoxybenzyl acetate;

the araliphatic ethers such as e.g. 2-phenylethyl methyl ether; 2-phenylethyl isoamyl ether; 2-phenylethyl 1-ethoxyethyl ether; phenylacetaldehyde dimethyl acetal; phenylacetaldehyde diethyl acetal; hydratropaaldehyde dimethyl acetal; phenylacetaldehyde glycerol acetal; 2,4,6-trimethyl-4-phenyl-1,3-dioxane; 4,4a,5,9b-tetrahydroindeno[1,2-d]m-dioxine; 4,4a,5,9b-tetrahydro-2,4-dimethylindeno[1,2-d]-m-dioxine;

the aromatic and araliphatic aldehydes such as e.g. benzaldehyde; phenylacetaldehyde; 3-phenylpropanal; hydratropaaldehyde; 4-methylbenzaldehyde; 4-methylphenylacetaldehyde; 3-(4-ethylphenyl)-2,2-dimethylpropanal; 2-methyl-3-(4-isopropylphenyl)propanal; 2-methyl-3-(4-tert-butylphenyl)propanal; 2-methyl-3-(4-isobutylphenyl)propanal; 3-(4-tert-butylphenyl)propanal; cinnamaldehyde; alpha-butylcinnamaldehyde; alpha-amylcinnamaldehyde; alpha-hexylcinnamaldehyde; 3-methyl-5-phenylpentanal; 4-methoxybenzaldehyde; 4-hydroxy-3-methoxybenzaldehyde; 4-hydroxy-3-ethoxybenzaldehyde; 3,4-methylenedioxybenzaldehyde; 3,4-dimethoxybenzaldehyde; 2-methyl-3-(4-methoxyphenyl)propanal; 2-methyl-3-(4-methylenedioxyphenyl)propanal;

the aromatic and araliphatic ketones such as e.g. acetophenone; 4-methylacetophenone; 4-methoxyacetophenone; 4-tert-butyl-2,6-dimethylacetophenone; 4-phenyl-2-butanone; 4-(4-hydroxyphenyl)-2-butanone; 1-(2-naphthalenyl)ethanone; 2-benzofuranylethanone; (3-methyl-2-benzofuranyl)ethanone; benzophenone; 1,1,2,3,3,6-hexamethyl-5-indanyl methyl ketone; 6-tert-butyl-1,1-dimethyl-4-indanyl methyl ketone; 1-[2,3-dihydro-1,1,2,6-tetramethyl-3-(1-methylethyl)-1H-5-indenyl]ethanone; 5',6',7',8'-tetrahydro-3',5',5',6',8',8'-hexamethyl-2-acetonaphthone;

the aromatic and araliphatic carboxylic acids and esters thereof such as e.g. benzoic acid; phenylacetic acid; methyl benzoate; ethyl benzoate; hexyl benzoate; benzyl benzoate; methyl phenylacetate; ethyl phenylacetate; geranyl phenylacetate; phenylethyl phenylacetate; methyl cinnamate; ethyl cinnamate; benzyl cinnamate; phenylethyl cinnamate; cinnamyl cinnamate; allyl phenoxyacetate; methyl salicylate; isoamyl salicylate; hexyl salicylate; cyclohexyl salicylate; cis-3-hexenyl salicylate; benzyl salicylate; phenylethyl salicylate; methyl 2,4-dihydroxy-3,6-dimethylbenzoate; ethyl 3-phenylglycidate; ethyl 3-methyl-3-phenylglycidate;

the nitrogen-containing aromatic compounds such as e.g. 2,4,6-trinitro-1,3-dimethyl-5-tert-butylbenzene; 3,5-dinitro-2,6-dimethyl-4-tert-butylacetophenone; cinnamonitrile; 3-methyl-5-phenyl-2-pentenonitrile; 3-methyl-5-phenylpentanonitrile; methyl anthranilate; methyl-N-methylanthranilate; Schiff bases of methyl anthranilate with 7-hydroxy-3,7-dimethyloctanal, 2-methyl-3-(4-tert-butylphenyl)propanal or 2,4-dimethyl-3-cyclohexenecarbaldehyde; 6-isopropylquiholine; 6-isobutylquinoline; 6-sec-butylquinoline; 2-(3-phenylpropyl)pyridine; indole; skatole; 2-methoxy-3-isopropyl-pyrazine; 2-isobutyl-3-methoxypyrazine;

the phenols, phenyl ethers and phenyl esters such as e.g. estragole; anethole; eugenol; eugenyl methyl ether; isoeugenol; isoeugenyl methyl ether; thymol; carvacrol; diphenyl ether; beta-naphthyl methyl ether; beta-naphthyl ethyl ether; beta-naphthyl isobutyl ether; 1,4-dimethoxybenzene; eugenyl acetate; 2-methoxy-4-methylphenol; 2-ethoxy-5-(1-propenyl)phenol; p-cresyl phenylacetate;

the heterocyclic compounds such as e.g. 2,5-dimethyl-4-hydroxy-2H-furan-3-one; 2-ethyl-4-hydroxy-5-methyl-2H-furan-3-one; 3-hydroxy-2-methyl-4H-pyran-4-one; 2-ethyl-3-hydroxy-4H-pyran-4-one;

the lactones such as e.g. 1,4-octanolide; 3-methyl-1,4-octanolide; 1,4-nonanolide; 1,4-decanolide; 8-decen-1,4-olide; 1,4-undecanolide; 1,4-dodecanolide; 1,5-decanolide; 1,5-dodecanolide; 4-methyl-1,4-decanolide; 1,15-pentadecanolide; cis- and trans-11-pentadecen-1,15-olide; cis- and trans-12-pentadecen-1,15-olide; 1,16-hexadecanolide; 9-hexadecen-1,16-olide; 10-oxa-1,16-hexadecanolide; 11-oxa-1,16-hexadecanolide; 12-oxa-1,16-hexadecanolide; ethylene 1,12-dodecanedioate; ethylene 1,13-tridecanedioate; coumarin; 2,3-dihydrocoumarin; octahydrocoumarin.

Within the context of the present invention, a "scent theme" is the prevailing scent note in a fragrance composition.

Within the context of the present invention, "fougère" or a "fragrance composition of the fougère type" is the combination of a fresh scent note such as e.g. citrus, a floral, herbaceous scent note such as e.g. lavender, an oriental scent note such as e.g. coumarin with a mossy scent note, such as e.g. oak moss. Synthetic or natural fragrances can be used.

Within the context of the present invention, "fresh" or a "fragrance composition of the fresh type" is related to the effect of the fragrances used according to the invention and/or to the fragrance composition according to the invention and is a subjective perception which can be brought about by different odor impressions. In the European sphere, this term is associated primarily with notes such as lemon, lavender, delicate, floral components, i.e. predominantly light, delicate elements. Synthetic or natural fragrances can be used.

Within the context of the present invention, "floral" or a "fragrance composition of the floral type" combines the scent of freshly cut flowers, such as e.g. of hyacinth, lavender, lily of the valley, rose, tuberoses, violet, geranium and jasmine and many more. Floral odor notes of the present invention can also be combined with powdery notes such as e.g. iris and vanilla to give light-floral scents or with e.g. orange blossom, linden blossom or sweet herbs to give floral-oriental scents. Synthetic or natural fragrances can be used.

Within the context of the present invention, "floral-fruity scents" have an additionally characterizing fraction of fruity notes. These determine primarily the top notes. The focus here will always lie on the floral elements.

Within the context of the present invention, the "top note" is the first phase of the scent progression of a perfume. It plays the decisive role during the first impression, upon opening the flacon and while applying the perfume to the skin. It is the task of the top note to generally arouse interest in the perfume and to ensure it gets noticed.

Consequently, an extraordinary character is often more important than a polished harmony. The top note is naturally determined by readily volatile fragrances.

On account of the odor note and material properties, (E)-enriched 4,8-dimethyl-3,7-nonadien-2-ol is particularly well suited for use as a constituent of a fragrance composition with a rose-like, floral scent.

Rose-like odor notes are used in a wide variety of perfume compositions and fragrance compositions, in particular e.g. also in fougère or floral (rosy) scent themes. The surprising rosy odor profile of (E)-enriched 4,8-dimethyl-3,7-nonadien-2-ol therefore contributes to the fact that this fragrance is particularly suitable for corresponding uses in these scent themes. Particularly in connection with fragrance compositions of the floral (rosy) or fougère type and especially when producing a rose scent, a large number of the positive properties of (E)-enriched 4,8-dimethyl-3,7-nonadien-2-ol becomes particularly distinct.

(E)-Enriched 4,8-dimethyl-3,7-nonadien-2-ol is preferably used as a constituent of fragrance compositions of the fougère type or of the floral (rosy) type.

On account of the odor note and material properties, (Z)-enriched 4,8-dimethyl-3,7-nonadien-2-ol is particularly well suited for use as a constituent of a fragrance composition with fruity-floral or fresh scent.

(Z)-Enriched 4,8-dimethyl-3,7-nonadien-2-ol is preferably used as a constituent of fragrance compositions with floral-fruity or fresh scents.

In order to obtain a fragrance composition with the most geraniol-like odor properties possible, (Z)-enriched 4,8-dimethyl-3,7-nonadien-2-ol or (E)-enriched 4,8-dimethyl-3,7-nonadien-2-ol is combined with tetrahydrogeraniol (3,7-dimethyl-octan-1-ol), with (Z)-enriched 4,8-dimethyl-3,7-nonadien-2-ol preferably being used. According to one preferred embodiment of this fragrance composition, citronellol (3,7-dimethyl-6-octen-1-ol) is additionally used. According to a particularly preferred embodiment of this fragrance composition, as well as citronellol, at least one further fragrance is additionally used, this being selected from citronellyl acetate (3,7-dimethyl-6-octen-1-ol acetate) and 2-phenylethyl alcohol.

Accordingly, a preferred aspect of the present invention relates to fragrance compositions which comprise 3,7-dimethyl-octan-1-ol and (Z)-enriched 4,8-dimethyl-3,7-nonadien-2-ol. A further aspect of the present invention relates to fragrance compositions which comprise 3,7-dimethyl-octan-1-ol and (E)-enriched 4,8-dimethyl-3,7-nonadien-2-ol. Particularly advantageous embodiments of the aforementioned aspects of the invention for producing a geraniol-like scent are:

- fragrance compositions comprising 3,7-dimethyl-octan-1-ol, (Z)-enriched 4,8-dimethyl-3,7-nonadien-2-ol and 3,7-dimethyl-6-octen-1-ol;
- fragrance compositions comprising 3,7-dimethyl-octan-1-ol, (E)-enriched 4,8-dimethyl-3,7-nonadien-2-ol and 3,7-dimethyl-6-octen-1-ol;
- fragrance compositions comprising 3,7-dimethyl-octan-1-ol, (Z)-enriched 4,8-dimethyl-3,7-nonadien-2-ol, 3,7-dimethyl-6-octen-1-ol and at least one further fragrance which is selected from 3,7-dimethyl-6-octen-1-ol acetate and 2-phenylethyl alcohol; and
- fragrance compositions comprising 3,7-dimethyl-octan-1-ol, (E)-enriched 4,8-dimethyl-3,7-nonadien-2-ol, 3,7-dimethyl-6-octen-1-ol and at least one further fragrance which is selected from 3,7-dimethyl-6-octen-1-ol acetate and 2-phenylethyl alcohol.

Preferably, the specified fragrance compositions according to the invention for producing a geraniol-like scent comprise, based on 100 parts by weight of 4,8-dimethyl-3,7-nonadien-2-ol:

- 90-240 parts by weight, in particular 120-200 parts by weight and preferably 140-190 parts by weight, e.g. 150-180 parts by weight, of 3,7-dimethyl-octan-1-ol;
- if present, 20-100 parts by weight, in particular 30-90 parts by weight and preferably 40-80 parts by weight, e.g. 45-70 parts by weight, of 3,7-dimethyl-6-octen-1-ol;
- if present, 7-24 parts by weight, in particular 9-20 parts by weight and preferably 11-16 parts by weight, e.g. 12-15 parts by weight, of 3,7-dimethyl-6-octen-1-ol acetate; and
- if present, 7-24 parts by weight, in particular 9-20 parts by weight and preferably 11-16 parts by weight, e.g. 12-15 parts by weight, of 2-phenylethyl alcohol.

In the specified fragrance compositions according to the invention for producing a geraniol-like scent, the total amount of 4,8-dimethyl-3,7-nonadien-2-ol and 3,7-dimethyl-octan-1-ol and, if present, 3,7-dimethyl-6-octen-1-ol, 3,7-dimethyl-6-octen-1-ol acetate and 2-phenylethyl alcohol is preferably at least 80% by weight, for example 90% by weight, at least 95% by weight, at least 97% by weight, at least 98% by weight or at least 99% by weight, and particularly preferably 100% by weight, based on the total weight of the fragrance composition.

The above-described fragrance compositions according to the invention for producing a geraniol-like scent can be used in order to replace geraniol or geraniol-containing compositions (e.g. mixtures of geraniol and nerol), in particular compositions with a geraniol fraction of at least 60% by weight, at least 70% by weight, at least 80% by weight, at least 90% by weight, at least 95%, at least 96% or more. Here, for replacing compositions with a particularly high geraniol content, such as e.g. of at least 80%, at least 90%, at least 95%, at least 96% or more, those fragrance compositions according to the invention that are suitable are particularly those which also comprise 3,7-dimethyl-octan-1-ol and 3,7-dimethyl-6-octen-1-ol as well as (Z)-enriched 4,8-dimethyl-3,7-nonadien-2-ol.

The invention relates to methods for conveying, modifying and/or intensifying a rose-like or citrus-like odor note in a fragrance composition.

The invention relates to a method for conveying, modifying and/or intensifying a rose-like odor note in a fragrance composition by admixing a sensorily effective amount of (E)-enriched 4,8-dimethyl-3,7-nonadien-2-ol.

In a mixture with other fragrances, (E)-enriched 4,8-dimethyl-3,7-nonadien-2-ol is even able to impart a rose-like odor note in low doses.

(E)-Enriched 4,8-dimethyl-3,7-nonadien-2-ol is suitable for a method for conveying, modifying and/or intensifying a rose-like odor note by admixing a mixture of this type into a fragrance composition.

Accordingly, a fragrance composition which comprises an organoleptically/sensorily effective amount of (E)-enriched 4,8-dimethyl-3,7-nonadien-2-ol is used in a method in order to convey, modify and/or intensify a rosy odor note.

Within the context of the present invention, "modify" means providing the basic theme of a fragrance composition with additional or different accords and odor nuances.

Within the context of the present invention, "accords" are formed by combining different fragrances which thus combine to give new odor images. The number of fragrances used can range from two to several hundred.

Within the context of the present invention, an "organoleptically/sensorily effective amount" is the amount of a fragrance which suffices to have a stimulatory effect on a sensory organ or stimulatory effect on a sensory receptor.

The invention also relates to methods for conveying, modifying and/or intensifying a rose-like odor note in a fragrance composition by admixing a sensorily effective amount of (Z)-enriched 4,8-dimethyl-3,7-nonadien-2-ol.

In a mixture with other fragrances, (Z)-enriched 4,8-dimethyl-3,7-nonadien-2-ol is able to convey, even in small dosages, to the fragrance composition a rose-like and, according to a further aspect, a fresh odor note.

(Z)-Enriched 4,8-dimethyl-3,7-nonadien-2-ol is suitable for a method for conveying, modifying and/or intensifying a rose-like odor note by admixing a mixture of this type in a fragrance composition.

Accordingly, a fragrance composition which contains an organoleptically/sensorily effective amount of (Z)-enriched 4,8-dimethyl-3,7-nonadien-2-ol is used in a method in order to convey, modify and/or intensify a rose-like odor note.

Particular preference is given to perfumed articles which comprise an amount of (E)-enriched 4,8-dimethyl-3,7-nonadien-2-ol which suffices to convey, to modify and/or to intensify a rose-like odor note to this article.

Particular preference is also given to perfumed articles which comprise an amount of (Z)-enriched 4,8-dimethyl-3,7-nonadien-2-ol which suffices to convey, to modify and/or to intensify a rose-like odor note to this article.

(E)- or (Z)-enriched 4,8-dimethyl-3,7-nonadien-2-ol suitable according to the invention or fragrance compositions according to the invention can be incorporated into a series of products and/or applied to said products.

Fragrances of this type are used in the production of perfumed articles. The olfactory properties, like the material properties (such as solubility in customary solvents and compatibility with further customary constituents of such products), as well as the toxicological acceptability of the fragrances according to the invention underline their particular suitability for the stated use purposes. The positive properties contribute to the fact that the fragrances used according to the invention and the fragrance compositions according to the invention are particularly preferably used in perfume products, body care products, hygiene articles, textile detergents, and in cleaners for solid surfaces.

The perfumed article is e.g. selected from perfume products, body care products, hygiene articles, textile detergents and cleaners for solid surfaces. Preferred perfumed articles according to the invention are also selected from among:

perfume products selected from perfume extracts, Eau de Parfums, Eau de Toilettes, Eau de Colognes, Eau de Solide, Extrait Parfum, air fresheners in liquid form, gel-like form or a form applied to a solid carrier, aerosol sprays, scented cleaners and oils;

body care products selected from aftershaves, pre-shave products, splash colognes, solid and liquid soaps, shower gels, shampoos, shaving soaps, saving foams, bath oils, cosmetic emulsions of the oil-in-water type, of the water-in-oil type and of the water-in-oil-in-water type, such as e.g. skin creams and lotions, face creams and lotions, sunscreen creams and lotions, aftersun creams and lotions, hand creams and lotions, foot creams and lotions, hair removal creams and lotions, aftershave creams and lotions, tanning creams and lotions, hair care products such as e.g. hairsprays, hair gels, setting hair lotions, hair conditioners, hair shampoo, permanent and semipermanent hair colorants, hair shaping compositions such as cold waves and hair smoothing compositions, hair tonics, hair creams and hair lotions, deodorants and antiperspirants such as e.g. underarm sprays, roll-ons, deodorant sticks, deodorant creams, products of decorative cosmetics such as e.g. eye shadows, nail varnishes, make-ups, lipsticks, mascara, toothpaste, dental floss;

hygiene articles selected from candles, lamp oils, joss sticks, insecticides, repellents, propellants, rust removers, perfumed freshening wipes, armpit pads, baby diapers, sanitary towels, toilet paper, cosmetic wipes, pocket tissues, dishwasher deodorizer;

cleaners for solid surfaces selected from perfumed acidic, alkaline and neutral cleaners, such as e.g. floor cleaners, window cleaners, dishwashing detergents, bath and sanitary cleaners, scouring milk, solid and liquid toilet cleaners, powder and foam carpet cleaners, waxes and polishes such as furniture polishes, floor waxes, shoe creams, disinfectants, surface disinfectants and sanitary cleaners, brake cleaners, pipe cleaners, lime scale removers, grill and oven cleaners, algae and moss removers, mold removers, facade cleaners;

textile detergents selected from liquid detergents, powder detergents, laundry pretreatments such as bleaches, soaking agents and stain removers, fabric softeners, washing soaps, washing tablets.

According to a further aspect, the fragrances used according to the invention and the fragrance compositions according to the invention are suitable for use in surfactant-containing perfumed articles. This is because fragrances and/or fragrance compositions with a rose top note and pronounced naturalness are often sought—especially for the perfuming of surfactant-containing formulations such as, for example, cleaners (in particular dishwashing compositions and all-purpose cleaners).

According to a further aspect, fragrances used according to the invention and fragrance compositions according to the invention can be used as agents for providing (a) hair or (b) textile fibers with a rosy odor note.

The fragrances to be used according to the invention and fragrance compositions according to the invention are therefore particularly well suited for use in surfactant-containing perfumed articles.

It is preferred if the perfumed article is one of the following:

- an acidic, alkaline or neutral cleaner which is selected in particular from the group consisting of all-purpose cleaners, floor cleaners, window cleaners, dishwashing detergents, bath and sanitary cleaners, scouring milk, solid and liquid toilet cleaners, powder and foam carpet cleaners, liquid detergents, powder detergents, laundry pretreatments such as bleaches, soaking agents and stain removers, fabric softeners, washing soaps, washing tablets, disinfectants, surface disinfectants,
- an air freshener in liquid form, gel-like form or a form applied to a solid carrier or as an aerosol spray,
- a wax or a polish, which is selected in particular from the group consisting of furniture polishes, floor waxes and shoe creams, or
- a body care composition, which is selected in particular from the group consisting of shower gels and shampoos shaving soaps, shaving foams, bath oils, cosmetic emulsions of the oil-in-water type, of the water-in-oil type and of the water-in-oil-in-water type, such as e.g. skin creams and lotions, face creams and lotions, sunscreen creams and lotions, aftersun creams and lotions, hand creams and lotions, foot creams and lotions, hair removal creams and lotions, aftershave creams and lotions, tanning creams and lotions, hair care products such as e.g. hairsprays, hair gels, setting hair lotions, hair conditioners, permanent and semipermanent hair colorants, hair shaping compositions such as cold waves and hair smoothing compositions, hair tonics, hair creams and hair lotions, deodorants and antiperspirants such as e.g. underarm sprays, roll-ons, deodorant sticks, deodorant creams, products of decorative cosmetics.

Ingredients with which fragrances used according to the invention or fragrance compositions according to the invention can preferably be combined are, for example: preservatives, abrasives, antiacne agents, agents to combat skin aging, antibacterial agents, anticellulite agents, antidandruff agents, anti-inflammatory agents, irritation-preventing agents, irritation-alleviating agents, antimicrobial agents, antioxidants, astringents, sweat-inhibiting agents, antiseptics, antistatics, binders, buffers, carrier materials, chelating agents, cell stimulants, cleaning agents, care agents, hair removal agents, surface-active substances, deodorizing agents, antiperspirants, emollients, emulsifiers, enzymes, essential oils, fibers, film formers, fixatives, foam formers, foam stabilizers, substances for preventing foaming, foam boosters, fungicides, gelling agents, gel-forming agents, hair care agents, hair shaping agents, hair smoothing agents, moisture-donating agents, moisturizing substances, humectant substances, bleaching agents, strengthening agents, stain removal agents, optical brighteners, impregnating agents, soil repellents, friction-reducing agents, lubricants, moisturizing creams, ointments, opacifiers, plasticizers, covering agents, polish, shine agents, polymers, powders, proteins, refatting agents, exfoliating agents, silicones, skin-calming agents, skin-cleansing agents, skin care agents, skin-healing agents, skin lightening agents, skin-protective agents, skin-softening agents, cooling agents, skin-cooling agents, warming agents, skin-warming agents, stabilizers, UV-absorbent agents, UV filters, detergents, fabric softeners, suspending agents, skin-tanning agents, thickeners, vitamins, oils, waxes, fats, phospholipids, saturated fatty acids, mono- or polyunsaturated fatty acids, α-hydroxy acids, polyhydroxy fatty acids, liquefiers, dyes, color-protection agents, pigments, anticorrosives, aromas, flavorings, fragrances, polyols, surfactants, electrolytes, organic solvents or silicone derivatives.

According to a further aspect, the fragrances are used in the production of the perfumed articles in liquid form, undiluted or diluted with a solvent or in the form of a fragrance composition. Suitable solvents for this purpose are e.g. ethanol, isopropanol, diethylene glycol monoethyl ether, glycerol, propylene glycol, 1,2-butylene glycol, dipropylene glycol, diethyl phthalate, triethyl citrate, isopropyl myristate, etc. If the specified solvents have their own olfactory properties, they are assigned exclusively to the constituent "solvent" and not to the "fragrances".

The fragrances and/or fragrance compositions present in the perfumed articles according to the invention can in this connection, in one embodiment, be absorbed onto a carrier, which ensures both fine distribution of the fragrance or fragrance composition within the product and also controlled release upon use. Carriers of this type may be porous inorganic materials such as light sulfate, silica gels, zeolites, gypsums, clays, clay granules, aerated concrete, etc. or organic materials such as woods and cellulose-based materials.

The fragrances used according to the invention and the fragrance compositions according to the invention can also be in microencapsulated form, spray-dried form, in the form of inclusion complexes or in the form of extrusion products and be added in this form to the product or article to be perfumed. The properties can be further optimized by so-called "coating" with suitable materials with regard to a more targeted release of the scent, for which purpose preferably waxy synthetic substances such as e.g. polyvinyl alcohol are used.

The microencapsulation can take place for example by the so-called coacervation method with the help of capsule materials, e.g. made of polyurethane-like substances or soft gelatin. The spray-dried perfume oils can be produced for example by spray-drying an emulsion or dispersion comprising the perfume oil, wherein carrier substances that can be used are modified starches, proteins, dextrin and vegetable gums. Inclusion complexes can be prepared e.g. by introducing dispersions of fragrance compositions and cyclodextrins or urea derivatives into a suitable solvent, e.g. water. Extrusion products can be prepared by melting fragrances used according to the invention and fragrance compositions according to the invention with a suitable wax-like substance and by extrusion with subsequent solidification, optionally in a suitable solvent, e.g. isopropanol.

(E)- or (Z)-enriched 4,8-dimethyl-3,7-nonadien-2-ol suitable according to the invention can be obtained from any desired mixture of (E)/(Z)-4,8-dimethyl-3,7-nonadien-2-ol, e.g. the reaction product of citral with methyl Grignard, by isomer separation or isomer enrichment. Here, the isomer separation can be achieved e.g. by rectification, adsorption or crystallization processes, preferably by rectification.

The invention relates to a process for the preparation of 4,8-dimethyl-3,7-nonadien-2-ol suitable as fragrance by reacting 3,7-dimethylocta-2,6-dienal, wherein the weight ratio of (E)-3,7-dimethylocta-2,6-dienal to the sum of (E)-3,7-dimethylocta-2,6-dienal and (Z)-3,7-dimethylocta-2,6-dienal is at least 80%, preferably at least 85%, further preferably at least 90%, particularly preferably at least 95%, furthermore particularly preferably at least 97% and especially preferably 100%, with an organometallic compound which transfers methyl groups.

The invention relates to a process for the preparation of 4,8-dimethyl-3,7-nonadien-2-ol suitable as fragrance by reacting 3,7-dimethylocta-2,6-dienal, in which the weight ratio of (Z)-3,7-dimethylocta-2,6-dienal to the sum of (E)-3,7-dimethylocta-2,6-dienal and (Z)-3,7-dimethylocta-2,6-dienal is at least 80%, preferably at least 85%, further preferably at least 90%, particularly preferably at least 95%, furthermore particularly preferably at least 97% and especially preferably 100%, with an organometallic compound which transfers methyl groups.

The organometallic compound which transfers methyl groups is selected from methyllithium, cuprates which comprise a structural unit $CH_3$—Cu—, methylsodium, zinc diorganyls which comprise a structural unit $CH_3$—Zn—, methyl zinc halides and methylmagnesium halides. Preferably, the organometallic compound which transfers methyl groups is selected from methyllithium, cuprates which comprise a structural unit $CH_3$—Cu—, zinc diorganyls which comprise a structural unit $CH_3$—Zn— and methylmagnesium halides. Methylmagnesium halides are particularly preferred, especially methylmagnesium bromide and methylmagnesium chloride.

(E)- or (Z)-enriched 4,8-dimethyl-3,7-nonadien-2-ol suitable according to the invention can be prepared by a so-called "Grignard reaction" described in customary standard works of preparative organic chemistry.

The reactions described above can take place in a temperature range from 10° C. to 70° C.

The reaction generally takes place in a suitable inert solvent. Suitable inert solvents are e.g. selected from diethyl ether, methyl tert-butyl ether or tetrahydrofuran.

The hydrolytic work-up takes place in a manner known per se, e.g. by treatment with a dilute aqueous acid. In this connection, the metal alcoholate is converted to the alcohol.

The invention is illustrated in more detail below by reference to examples.

4,8-Dimethyl-3,7-nonadien-2-ols with different E/Z ratios were placed in front of a panel of experienced odor testers. The odor descriptions are summarized in the table below.

EXAMPLE 1

| Isomer mixture | (E)-4,8-Dimethyl-3,7-nonadien-2-ol/(Z)-4,8-dimethyl-3,7-nonadien-2-ol | Odor description |
|---|---|---|
| 1_1 | 10/86 | rosy, green, minty |
| 1_2 | 15/82 | rosy, floral, green, minty |
| 1_3* | 60/39 | rosy, metallic, herbaceous, moldy |
| 1_4 | 85/13 | rosy, floral, citrus, accompanying note fruity (rhubarb) |
| 1_5 | 98/0 | rosy, floral, citrus, fruity (rhubarb) and herbaceous |

*Not according to the invention

All of the isomer mixtures have the desired rose component. Mixtures 1_1 and 1_2 have attractive fresh minty accompanying notes. Mixtures 1_4 and 1_5 have attractive fruity accompanying notes of citrus and rhubarb. By contrast, mixture 1_3 has undesired and nonspecific notes (moldy, herbaceous, flat, metallic).

Accordingly, the fragrances to be used according to the invention have a distinct rose-like, floral character. Citrus-like, minty, green accompany notes reminiscent of rhubarb arise.

EXAMPLE 2

Further experiments were carried out using a material which comprised 86% by weight of (Z)-4,8-dimethyl-3,7-nonadien-2-ol and 10% by weight of (E)-4,8-dimethyl-3,7-nonadien-2-ol and which is referred to hereinbelow as material A.

To assess the odor of material A, it was tested in a representative demonstration formula which comprised material A and diluent/solvent. Here, the odor of material A was assessed as follows: warm, rosy, fresh, with rich floweriness, with a slight rose oxide effect, with the typical fruity warmth of geraniol, strong scent radiance and scent intensity.

EXAMPLE 3

Mixtures of material A and various other fragrances were prepared and investigated. It was found here that a strong approximation to the odor properties of geraniol could be achieved particularly using the fragrance compositions of formulae 2_1 to 2_5 (see table below).

| Fragrance | Formula 2_1 | Formula 2_2 | Formula 2_3 | Formula 2_4 | Formula 2_5 |
|---|---|---|---|---|---|
| 2-Phenylethyl alcohol | 4.0 | | | | 4.0 |
| Citronellol | 16.0 | 20.0 | 15.8 | 17.0 | 16.0 |
| Tetrahydrogeraniol | 48.0 | 50.0 | 52.6 | 53.0 | 46.0 |
| Citronellyl acetate | 4.0 | | | | 4.0 |
| Material A | 28.0 | 30.0 | 31.6 | 30.0 | 30.0 |

[Quantitative data in % by weight, based on the total amount of fragrance composition.]

In the experiments with material A, it was established that binary fragrance mixtures of tetrahydrogeraniol and material A have clear geraniol-like odor properties. An even greater approximation to the odor properties of geraniol was achieved with fragrance mixtures which comprised citronellol, tetrahydrogeraniol and material A (such as e.g. the mixtures of formulae 2_1 to 2_5). Among the investigated fragrance compositions, the mixture of formula 2_5 and in particular that of formula 2_1 exhibited the most geraniol-like odor properties.

By contrast, binary fragrance mixtures of citronellol and tetrahydrogeraniol lacked the typical fruity warmth of geraniol and its strong scent radiance and scent intensity.

The invention claimed is:

1. A fragrance composition comprising 4,8-dimethyl-3,7-nonadien-2-ol, and 3,7-dimethyl-octan-1-ol, wherein the weight ratio of (E)-4,8-dimethyl-3,7-nonadien-2-ol to the sum of (E)- and (Z)-4,8-dimethyl-3,7-nonadien-2-ol is at least 80%.

2. The fragrance composition according to claim 1, comprising 90-240 parts by weight of 3,7-dimethyl-octan-1-ol, based on 100 parts by weight of 4,8-dimethyl-3,7-nonadien-2-ol.

3. The fragrance composition according to claim 2, where the total amount of 4,8-dimethyl-3,7-nonadien-2-ol and 3,7-dimethyl-octan-1-ol and, if present, 3,7-dimethyl-6-octen-1-ol, 3,7-dimethyl-6-octen-1-ol acetate and 2-phenylethyl alcohol constitutes at least 80% by weight of the fragrance composition.

4. The fragrance composition according to claim 1, further comprising 3,7-dimethyl-6-octen-1-ol.

5. The fragrance composition according to claim 4, comprising 20-100 parts by weight of 3,7-dimethyl-6-octen-1-ol, based on 100 parts by weight of 4,8-dimethyl-3,7-nonadien-2-ol.

6. The fragrance composition according to claim 1, further comprising at least one further fragrance which is selected from 3,7-dimethyl-6-octen-1-ol acetate and 2-phenylethyl alcohol.

7. The fragrance composition according to claim 6, comprising in each case 7-24 parts by weight of the at least one further fragrance which is selected from 3,7-dimethyl-6-octen-1-ol acetate and 2-phenylethyl alcohol, based on 100 parts by weight of 4,8-dimethyl-3,7-nonadien-2-ol.

8. A perfumed article comprising the fragrance composition according to claim in claim 1.

9. The perfumed article according to claim 8, wherein the perfumed article is selected from a perfume product, body care product, hygiene article, textile detergent or cleaner for hard surfaces.

10. A fragrance composition comprising 4,8-dimethyl-3,7-nonadien-2-ol wherein the weight ratio of (Z)-4,8-dimethyl-3,7-nonadien-2-ol to the sum of (E)- and (Z)-4,8-dimethyl-3,7-nonadien-2-ol is at least 80%.

11. A method for conveying, modifying or intensifying a rose-like odor more in a fragrance composition by admixing a sensitivity effective amount of 4,8-dimethyl-3,7-nonadien-2-ol as defined in claim 10.

12. The fragrance composition according to claim 10, further comprising 3,7-dimethyl-octan-1-ol.

13. The fragrance composition according to claim 12, comprising 90-240 parts by weight of 3,7-dimethyl-octan-1-ol, based on 100 parts by weight of 4,8-dimethyl-3,7-nonadien-2-ol.

14. A rose scented, perfumed article comprising the fragrance composition according claim 12, wherein the perfumed article is selected from a perfume product, body care product, hygiene article, textile detergent or cleaner for hard surfaces.

15. The fragrance composition of claim 12, further comprising 3,7-dimethyl-6-octen-1-ol.

16. The fragrance composition of claim 12, further comprising at least one further fragrance which is selected from 3,7-dimethyl-6-octen-1-ol acetate and 2-phenyethyl alcohol.

17. A method for conveying, modifying and/or intensifying a rose-like odor note in a fragrance composition by admixing a sensorily effective amount of 4,8-dimethyl-3,7-nonadien-2-ol, wherein the weight ratio of (E)-4,8-dimethyl-3,7-nonadien-2-ol to the sum of (E)- and (Z)-4,8-dimethyl-3,7-nonadien-2-ol is at least 80%.

* * * * *